US006009699A

United States Patent [19]

Delvael

[11] Patent Number: 6,009,699

[45] Date of Patent: Jan. 4, 2000

[54] COMPOSITE SYNTHETIC STRING FOR A TENNIS RACKET

[75] Inventor: Yves Delvael, Belgique, France

[73] Assignee: Cousin Biotech (S.A.R.L.), France

[21] Appl. No.: 08/987,400

[22] Filed: Dec. 9, 1997

[30] Foreign Application Priority Data

Oct. 23, 1997 [FR] France ..... 97 13277

[51] Int. Cl.[7] ..... D02G 3/36

[52] U.S. Cl. ..... 57/232; 57/210; 57/224; 57/230; 57/234; 57/241; 57/250; 57/258

[58] Field of Search ..... 57/210, 224, 230, 57/232, 234, 241, 242, 250, 251, 258

[56] References Cited

U.S. PATENT DOCUMENTS

| | | | |
|---|---|---|---|
| 3,745,456 | 7/1973 | Crandall | 57/234 |
| 4,084,399 | 4/1978 | Kanemaru et al. | 57/210 |
| 4,183,200 | 1/1980 | Bajaj | 57/234 |
| 4,606,392 | 8/1986 | Weidenhaupt et al. | 152/451 |
| 5,145,172 | 9/1992 | Takashima | 273/73 R |

FOREIGN PATENT DOCUMENTS

| | | |
|---|---|---|
| 0049196 | 8/1985 | European Pat. Off. . |
| 2491098 | 9/1980 | France . |

*Primary Examiner*—William Stryjewski
*Attorney, Agent, or Firm*—Duane, Morris & Heckscher

[57] ABSTRACT

Composite synthetic string, in particular for a tennis racket. According to the invention, the string is made up of central monofilaments surrounded by mono-filament threads and by multifilament threads, the assembly being impregnated and covered in polyurethane. The string is applicable to tennis rackets having increased lifetime and that react in lively manner under the impact of a ball.

4 Claims, 1 Drawing Sheet

COMPOSITE SYNTHETIC STRING FOR A TENNIS RACKET

The present invention relates to composite synthetic string intended particularly but not exclusively for stringing tennis rackets.

BACKGROUND OF THE INVENTION

Composite synthetic strings are already known. FR-A-2 491 098 discloses synthetic string having two components: polyurethane and multifilament threads of polyamide, the multifilaments being embedded in a polyurethane matrix. The polyurethane binder has breaking elongation that is much greater than that of the polyamide, and in conjunction with a special structure for the string it makes it possible to obtain high breaking strength with medium hardness, which gives rise to the string returning quickly to its initial position after the impact of a ball.

Also, there have appeared tennis rackets with a rigid frame made using an appropriate choice of materials (carbon, boron, etc. . . . ), and above all by using much thicker sections. In such rackets, the frame hardly deforms at all under the impact of a ball, unlike what used to happen. It is thus the stringing that has to absorb all of the force due to the impact of the ball. Under such conditions, the strings move less, and there is considerably less wear by abrasion due to the strings rubbing against one another, particularly during "lift" shots during which the main strings move over the cross strings. However, a denting phenomenon develops and becomes predominant, i.e. a phenomenon of localized wear which gives rise to dents appearing in the cross-strings, which dents decrease the section of the string very quickly and cause it to break. This phenomenon increases with increasing string hardness.

Thus, when such frames are used with monofilament strings, players say that the stringing "explodes". In fact, what happens is that a set of strings break after they have been dented as the result of friction between the strings.

The same phenomenon exists, though to a lesser extent, with string of the type described in the above patent. That string has an outside surface of polyurethane which is not as hard as the monofilament threads, and is consequently better at withstanding denting than are strings based on monofilaments.

OBJECTS AND SUMMARY OF THE INVENTION

An object of the present invention is to make use of this advantage and to extend considerably the lifetime of tennis racket stringing, even when the racket has a rigid frame.

The present invention provides composite synthetic string, in particular for a tennis racket, comprising threads of a first synthetic material and a binder of a second synthetic material impregnating said spiral-wound threads through to the core, uniting them, and covering them, the melting point of the binder being lower than that of the threads and its breaking elongation being much greater than that of the threads, said threads being constituted by multifilaments, wherein monofilaments are disposed in the center of the string.

The central monofilaments are preferably oblong monofilaments of very high tenacity, of a section that is generally rectangular in shape with rounded edges. They constitute a kind of core for the string.

Preferably, they are surrounded by a limited number, e.g. four, circular section monofilaments constituting an antiwear shield in addition to the binder forming the skin of the string and enabling it to withstand wear better and to last longer regardless of the type of wear: lift, flat play, and more particularly denting.

Compared with a string made according to the teaching of patent FR-A-2 491 098, a lifetime that is 30% to 40% longer has been observed for each of the players tested, with string wear naturally depending on the type of game played and varying with each player.

BRIEF DESCRIPTION OF THE DRAWING

Other characteristics and advantages of the invention appear from the following description of a particular embodiment, given solely by way of non-limiting [2]example, and with reference to the drawing, in which.

MORE DETAILED DESCRIPTION

Figure 1:
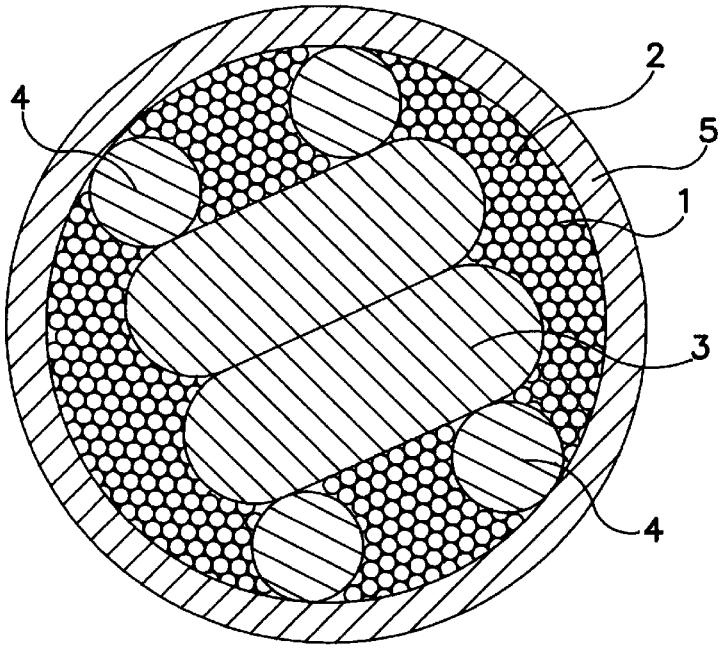
FIG. 1 is a cross-section through a string of the present invention.

In FIG. 1, it can be seen that the string of the invention is made up of polyurethane 1 forming the matrix of the string, impregnating and surrounding the multifilaments and the monofilaments. The polyurethane is to be found between the multifilaments 2, the central monofilaments 3 and the outer monofilaments 4, and thus constitutes a homogeneous assembly. It also constitutes the skin or outer envelope layer of the string. Inside the matrix of multifilaments, there are distributed at the center of mass thereof, oblong monofilaments 3 which, in the example shown, are two in number. The periphery of the four monofilaments 4 comes close to the envelope 5 of the multifilaments. The number of monofilaments 4 may lie in the range three to six. However in all cases the monofilaments 4 are secured to the matrix of multifilaments. It is essential for the monofilaments 4 to be securely anchored in the vicinity of the periphery of the multifilaments so as to be in contact with the adjacent string after polyurethane has worn.

Thus, in the phenomenon of wear and of denting, the monofilaments 4 come into action once the polyurethane has worn to protect the multifilaments 2 and the monofilaments 3 which perform the major portion of the dynamic work of the string. The string of the invention which is stiffened by the presence of the monofilaments is also easier to string.

The multifilaments 2 and the monofilaments 3 and 4 are constituted by the polyamide known by the name "Nylon0.66", having a Shore hardness on the D scale of 85, whereas the Shore hardness on the D scale of polyurethane is much less than that.

The method of manufacturing such a string by twisting is analogous to that described in the above-mentioned patent, i.e. the monofilaments and the multifilaments are coated prior to twisting at a twisting rate of 50 to 200 turns per meter, with the string, after twisting and after the solvent has evaporated, being passed through a die to make its outline uniform and to remove excess polyurethane.

Figure 2:
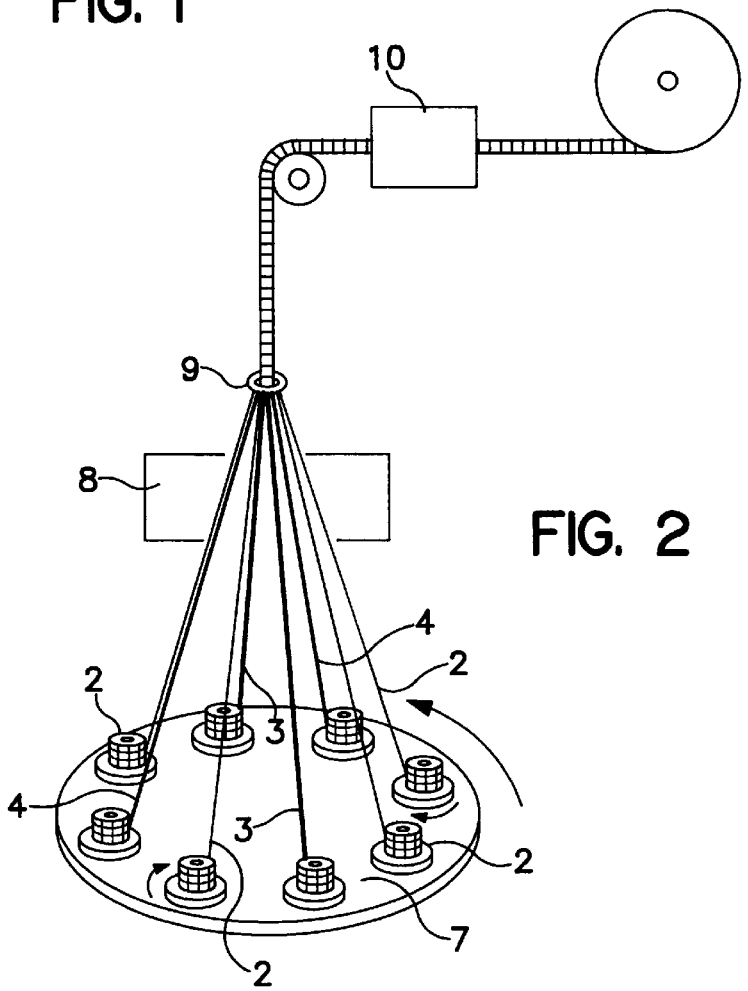
FIG. 2 is a diagrammatic view of the method of making such a string.

In FIG. 2, there can be seen reels of multifilaments 2, reels of oblong monofilaments 3, and reels of circular monofilaments 4 all mounted on a turntable 7 on which the threads are coated in a polyurethane solution. The threads 2, 3, and 4 pass through an oven 8 which evaporates off the solvent and prepolymerized the polyurethane. Thereafter the threads are thrown in a ring 9 and the binder is finally polymerized in an oven 10. The string can thus be made in a single operation without restarting.

EXAMPLE

The string shown in FIG. 1 has a diameter of 1.30 mm and an ultimate breaking strength of more than 80 daN. Its breaking elongation is about 25%, and its mass is 1.5 grams per meter.

It is made up of two oblong monofilaments, each of 2,200 decitex, four circular monofilaments each of 380 decitex and having a diameter of 20/100 of a millimeter, and four multifilament threads each including 140 filaments having a diameter of 28 microns. The set of threads is twisted at a rate of 80 turns per meter.

Although the multifilaments and the monofilaments in the above description are made of polyamide, that material can be replaced with any other synthetic material that has good abrasion resistance, such as polyester, for example. The central monofilament threads may be of arbitrary section providing each has a flat side so as to enable the two threads to come into contact with each other over an area rather than on an edge, and naturally numerous variants can be devised, in particular by substituting technically equivalent means, without thereby going beyond the ambit of the invention.

I claim:

1. A composite string, in particular for a tennis racket, the string comprising:

a pair of monofilament threads each having at least one flat side;

a plurality of monofilament threads having circular cross sections surrounding said pair of flat sided monofilaments, the circular and flat sided monofilaments being disposed in the center of the string and together defining a string core;

a plurality of spiral-wound multifilament threads surrounding the monofilaments; and a synthetic binder impregnating the spiral-wound threads through to the core, uniting them and covering them, the binder having a melting point being lower than the threads and a breaking elongation being greater than that of the threads.

2. Composite string according to claim 1, wherein the flat sided monofilaments are oblong monofilaments.

3. Composite string according to claim 1, wherein the monofilaments and the multifilament threads are made of polyamide, the binder being constituted by polyurethane.

4. Composite string according to claim 1, including two oblong monofilaments of 2,200 decitex each, four monofilaments of 380 decitex each, and four multifilament threads each including 140 filaments.

* * * * *